US008764463B2

(12) United States Patent
Byrne et al.

(10) Patent No.: US 8,764,463 B2
(45) Date of Patent: Jul. 1, 2014

(54) WATERPROOF SIMPLEX RECEPTACLE WITH ADDITIONAL WATERSHEDDING

(71) Applicants: Norman R. Byrne, Ada, MI (US); Timothy J. Warwick, Sparta, MI (US); Joseph D. Ward, Grand Rapids, MI (US)

(72) Inventors: Norman R. Byrne, Ada, MI (US); Timothy J. Warwick, Sparta, MI (US); Joseph D. Ward, Grand Rapids, MI (US)

( * ) Notice: Subject to any disclaimer, the term of this patent is extended or adjusted under 35 U.S.C. 154(b) by 0 days.

(21) Appl. No.: 13/936,750

(22) Filed: Jul. 8, 2013

(65) Prior Publication Data

US 2013/0295787 A1 Nov. 7, 2013

Related U.S. Application Data

(63) Continuation of application No. 12/816,089, filed on Jun. 15, 2010, now Pat. No. 8,480,415.

(60) Provisional application No. 61/268,702, filed on Jun. 15, 2009.

(51) Int. Cl.
*H01R 4/66* (2006.01)

(52) U.S. Cl.
USPC ..... 439/106; 439/685

(58) Field of Classification Search
USPC ..... 439/106, 107, 685, 686, 689
See application file for complete search history.

(56) References Cited

U.S. PATENT DOCUMENTS

| | | | | |
|---|---|---|---|---|
| 2,249,827 | A | 7/1941 | Herman | |
| 3,611,257 | A | 10/1971 | Carkhuff | |
| 3,850,496 | A | 11/1974 | Hague | |
| 4,372,629 | A | 2/1983 | Propst | |
| 4,747,788 | A | 5/1988 | Byrne | |
| 4,984,982 | A | 1/1991 | Brownlie | |
| 5,234,355 | A | 8/1993 | Sosinski et al. | |
| 5,575,668 | A | 11/1996 | Timmerman | |
| 5,647,751 | A | 7/1997 | Shulman et al. | |
| 5,709,156 | A | 1/1998 | Gevaert | |
| 6,290,512 | B1 | 9/2001 | Mullen, Jr. | |
| 6,315,617 | B1 * | 11/2001 | Al-Sabah | 439/652 |
| 6,488,540 | B2 | 12/2002 | Coyle et al. | |
| 6,902,429 | B1 * | 6/2005 | Brooks | 439/535 |
| 6,923,663 | B2 * | 8/2005 | Oddsen et al. | 439/107 |
| 6,981,896 | B2 | 1/2006 | Su | |
| 7,204,727 | B2 * | 4/2007 | Germani | 439/835 |
| 7,244,128 | B2 | 7/2007 | Byrne | |
| 7,258,564 | B1 | 8/2007 | Su | |
| 7,520,783 | B2 * | 4/2009 | Chou et al. | 439/652 |
| 7,833,037 | B2 | 11/2010 | Reusche et al. | |
| 8,480,415 | B2 | 7/2013 | Byrne | |

OTHER PUBLICATIONS

Heyco datasheet entitled "Preassembled Cordset Components: Tri-Tap Premold-NEMA 5-15R," available at http://www.heyco.com/Power_Components/pdf/8-28.pdf.

* cited by examiner

*Primary Examiner* — Thanh Tam Le
(74) *Attorney, Agent, or Firm* — Gardner, Linn, Burkhart & Flory, LLP

(57) ABSTRACT

A waterproof simplex receptacle includes a main body and a front portion. The front portion includes a front surface and rear surface. Terminals are recessed rearwardly from openings formed in the front surface, and are connected to wires extending rearwardly from the main body. The front surface includes a first surface portion, in the vicinity of the openings, which is positioned forwardly from a second surface portion that is located generally outboard of the first surface portion. Optionally, the first surface portion may be in the form of outwardly-extending ridges around the terminal openings, a convex surface, or a sloped or slanted surface, for example, and configured to direct water or other liquids away from the terminal openings associated with the terminals.

19 Claims, 7 Drawing Sheets

Fig. 13
(Prior Art)
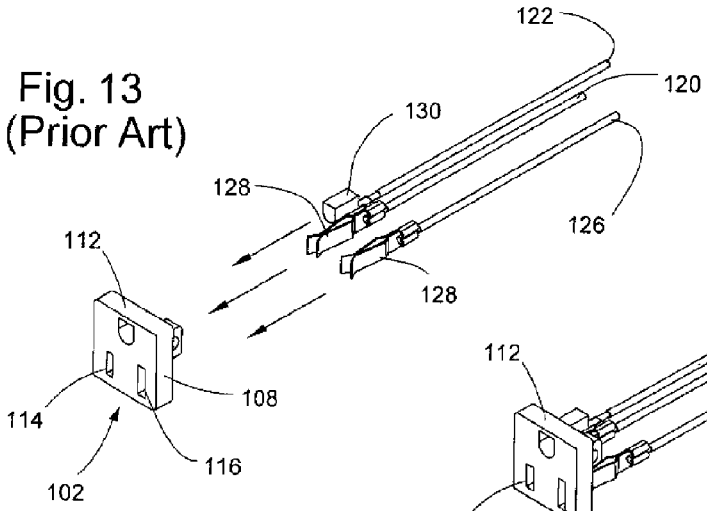
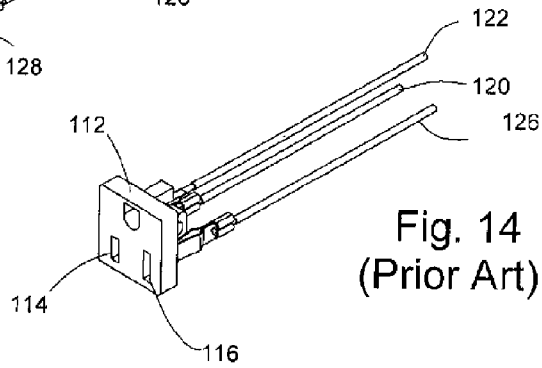
Fig. 14
(Prior Art)
Fig. 15
(Prior Art)
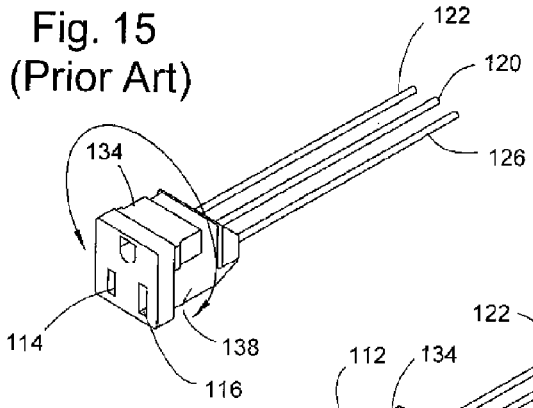
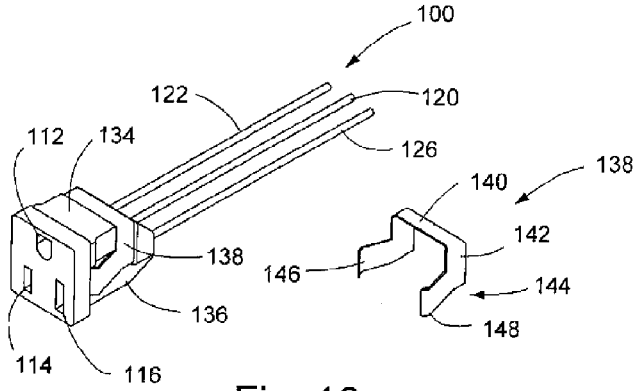
Fig. 16
(Prior Art)

WATERPROOF SIMPLEX RECEPTACLE WITH ADDITIONAL WATERSHEDDING

CROSS REFERENCE TO RELATED APPLICATIONS

This application is a continuation of U.S. patent application, Ser. No. 12/816,089, filed Jun. 15, 2010, which claims priority of U.S. Provisional Application, Ser. No. 61/268,702, filed Jun. 15, 2009, which are hereby incorporated herein by reference in their entireties.

FIELD OF THE INVENTION

The invention relates to electrical systems and, more particularly, to electrical receptacles mounted in configurations where they may be susceptible to water or other liquid damage or danger.

BACKGROUND OF THE INVENTION

The use of computers, telecommunications equipment and other electronic devices is continuing to rapidly increase in office, commercial, industrial and other environments. As a result, the importance of efficiently supplying power throughout these environments is also increasing. Historically, one problem with use of electrical power is the positioning of electrical power outlet ports, such as electrical receptacles. Positioning of these devices is important with respect to both convenience and cost efficiency. Electrical receptacles for supplying power to various types of devices (lighting, computers, etc) must be located in accessible positions for all types of use.

In this regard, it is known to employ electrical receptacles directly mounted to various types of furniture, such as bookshelves and desks. These receptacles may be mounted at a location substantially above a floor surface, and allow the user to interconnect electrical devices near their locations of use, thereby avoiding the necessity of running device cords and cables a substantial distance.

A system employing covered receptacles mounted within a workstation is disclosed in Propst, U.S. Pat. No. 4,372,629 issued Feb. 8, 1993. The Propst arrangement includes a desk top having a rear cover hinged to a vertical back panel. Receptacles are mounted to the lower portion of the cover and bristles extend horizontally from the cover to an edge of the desktop when the cover is closed. When the cover is opened, the user can "plug in" the cord of a desired electrical device and close the cover, with the cord then extending through the bristles.

A further advance of the prior art was achieved with the commonly owned Byrne, U.S. Pat. No. 4,747,788 issued May 31, 1988. In this patent, a retractable power center is disclosed which is manually operable. The power center includes a movable and vertically slidable power carriage utilized to mount electrical receptacles. The carriage can be extended between an open position and a closed, retracted position.

In Brownlie, et al., U.S. Pat. No. 4,984,982 issued Jan. 15, 1991 an access flooring module is provided, which is mounted in an opening provided in a floor. The module is moveable between open and closed positions, so as to receive electrical components such as power sockets.

Timmerman, U.S. Pat. No. 5,575,668, issued Nov. 19, 1996 discloses a temporary power/data tap for delivery electrical power and data service to a work surface from a distant standard wall or floor mounted electrical receptacle. Another device comprising utility receptacles and specifically directed to use in a work surface is disclosed in Gevaert, et al., U.S. Pat. No. 5,709,156 issued Jan. 20, 1998.

In accordance with the foregoing, various types of configurations exist with respect to mounting electrical receptacles. However, one problem with a number of known electrical receptacles relates to the potential damage (or dangerous situations) from environmental conditions. For example, electrical receptacles may be constructed and configured in such a way as to be susceptible to damage from water or other fluids. As well known in the electrical industry, water spillage or the like may result not only in damage to electrical components, but may also cause dangerous situations, due to electrical arcing or similar electrical malfunctions caused by water spillage and seepage.

In this regard, a substantial advance in the art was achieved through the development of waterproof simplex receptacles as disclosed in Byrne, U.S. Pat. No. 7,244,128, issued Jul. 17, 2007. The Byrne '128 patent is incorporated by reference herein. Specifically, the Byrne '128 patent discloses the use of a simplex receptacle body having a front portion with a front surface and rear surface. Terminals extend through the front portion, and are disclosed as including a ground terminal, neutral terminal and hot terminal. The terminals are electrically connected to a set of electrical wires or cables extending rearwardly from the receptacle. The receptacle also includes a rear housing. A waterproofing clip is disclosed which includes an upper portion extending lengthwise across the clip, and a pair of vertically connecting portions extending downwardly from opposing ends of the upper portion. At the lower ends of the vertical connecting portions, spring legs extend forwardly from each of the vertical connecting portions. The spring clips are resilient in nature and sized so as to be "snap fitted" around the main housing body of the rear housing. With the rear housing and the waterproofing clip, the rear portion of the simplex receptacle is essentially waterproof, and resists seepage of water or other liquids therein.

SUMMARY OF THE INVENTION

In accordance with the invention, an electrical receptacle assembly includes at least one receptacle. The receptacle assembly has a main receptacle body, with a front portion and a front surface thereof. A series of terminals extends through the front portion and outwardly through the front surface. The terminals receive an electrical plug of an electrical device to be energized. The assembly also includes a series of electrical wires or cables, numbering the same as the number of electrical terminals associated with the main receptacle body. The wires or cables are adapted to provide electrical power when electrically coupled to the main receptacle body. The main receptacle body includes a rear body housing positioned at a rear of the front portion. In accordance with one aspect of the invention, each of the terminals extending through the front surface includes an outwardly extending ridge. Each of the ridges is sized and configured so that if the front surface is positioned at any angle between horizontal and vertical, inclusive, liquid located on the front surface is prevented from dripping through the terminals as a result of the size and configuration of the ridges.

In accordance with the further aspect of the invention, the assembly includes a waterproofing clip having a resilient configuration, adapted to be snap fitted around the rear body housing and coupled to the main receptacle body. The clip includes an upper portion extending lengthwise, a pair of vertically connecting portions extending downwardly from the upper portion, and a pair of resilient legs extending forwarding from lower ends of the vertically connecting portions.

In accordance with a further aspect of the invention, the front surface is angled, so that if the front portion is laid flat against a horizontal surface, the front surface will be positioned at an angle relative to the horizontal surface. The angle is sufficient in size and configured so that the front surface will tend to shed water.

In accordance with still another aspect of the invention, the front surface includes a curved configuration. The curved configuration is such that if the front portion is positioned supine, liquid dripping downwardly onto the front surface will be directed outwardly toward an edge of the front portion and off of the front surface. Still further, the curvature of the front surface can be such that each point on the front surface can slope outwardly toward the edge of the front portion.

In accordance with a further aspect of the invention, the receptacle assembly includes at least two terminals extending from the front surface. A resilient protective element is positioned immediately below the front surface and positioned in between the two terminals. The resilient element includes a pair of resilient portions covering each of the two terminals when not in use. The resilient portions are connected together by a mid-section. When terminal blades are inserted into the terminals, the blades abut the resilient portions and exert forces on the portions so as to cause the protective element to bend inwardly and downwardly. When the resilient portions are bent inwardly and downwardly, the terminal blades are free to move into and be received within the terminals. When the blades are removed from the terminals, the resilient portions return to positions which cover and shield the terminals.

A further aspect of the invention includes a baffle element positioned substantially below the front surface and in between the two terminals. The baffle element includes a baffle mid-portion positioned directly below the front portion in between the two terminals. The baffle mid-portion is connected to a resilient and triangular wedge which extends partially upwardly into and covers one of the terminals when not in use. A flat portion is integral with or otherwise connected to an opposing end of the baffle mid-portion. When blades are extended into the terminals, the triangular wedge is made to move downwardly so as to be free to move in a horizontal configuration. With the baffle mid-portion essentially holding the flat portion and the triangular wedge in a configuration where the baffle mid-portion tends to contract, the mid-portion is free to contract when the triangular wedge is removed from abutment with one of the terminals. When the blades are extended downwardly, the baffle element contracts to a configuration where the terminal blades are free to move downwardly and into the terminals. When the terminal blades are removed, the baffle element returns to a state which will prevent seepage of liquid through the terminals. Still further, the flat portion of the baffle element can be coupled to, or otherwise replaced by a further triangular wedge which abuts the other terminal when the blades are removed from the terminal.

BRIEF DESCRIPTION OF THE SEVERAL VIEWS OF THE DRAWING

The invention will now be described with reference to the drawings, in which:

FIG. 13 is a perspective and partially exploded view, somewhat similar to FIG. 7, in that it shows the positioning of the electrical wires or cables as they are being interconnected to the simplex receptacle body;

FIG. 14 is a perspective view similar to FIG. 13, but showing the electrical wires or cables interconnected to the simplex receptacle body;

FIG. 15 is similar to FIG. 11, but shows, in perspective view, the interconnected simplex receptacle body, rear housing, electrical wires or cables, and the waterproofing clip in a position to be connected;

FIG. 16 is similar to FIG. 12, but shows the entire interconnection of the waterproof simplex receptacle, in perspective view;

DETAILED DESCRIPTION OF THE PREFERRED EMBODIMENTS

Figure 4:
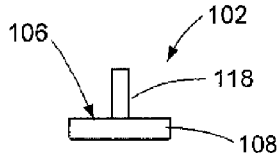
Fig. 4 (Prior Art)
FIG. 4 is a plan view of the simplex receptacle body shown in FIG. 1.
Figure 3:
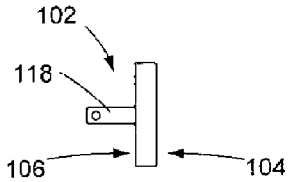
Fig. 3 (Prior Art)
FIG. 3 is a left-side view of the simplex receptacle body shown in FIG. 1.
Figure 1:
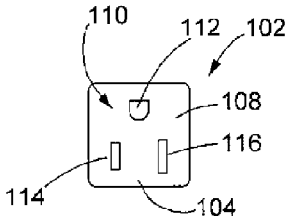
Fig. 1 (Prior Art)
FIG. 1 is an elevation view of a known simplex receptacle body.
Figure 2:
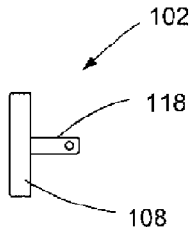
Fig. 2 (Prior Art)
FIG. 2 is a right-side view of the simplex receptacle body shown in FIG. 1.
Figure 5:
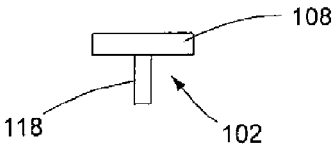
Fig. 5 (Prior Art)
FIG. 5 is an underside view of the simplex receptacle body shown in FIG. 1.

The principles of the invention are disclosed, by way of example, in a number of embodiments of waterproof simplex receptacles having structure and features directed to water-shedding. These embodiments are illustrated in FIGS. 17-30. For purposes of understanding general principles of waterproof simplex receptacles, a waterproof simplex receptacle 100 will first be described with respect to FIGS. 1-16. This particular simplex receptacle 100 is disclosed in commonly owned Byrne U.S. Pat. No. 7,244,128 issued Jul. 17, 2007. Following the descriptions of simplex receptacle 100, the embodiments of the simplex receptacle in accordance with the invention will be described.

The waterproof simplex receptacle includes a receptacle body having electrical wires or cables interconnected thereto. A rear housing is formed around the rear portion of the receptacle body, and substantially encloses the electrical wires or cables. For purposes of providing waterproof properties, a waterproofing clip is appropriately sized and configured so as to fit around portions of the rear housing, in a manner so as to "block" any openings and prevent any water seepage into the rear housing.

Turning to the drawings, FIGS. 1-5 illustrate, standing alone, a simplex receptacle body 102 in accordance with the invention. With specific reference to FIGS. 1-5, the receptacle body 102 includes a front portion 108 having a substantially square or otherwise rectangular configuration. The front portion 108 includes a front surface 104 and a rear surface 106. Extending through the front portion 108 are a series of three terminals 110. In the particular embodiment disclosed herein, the terminals include a ground terminal 112, neutral terminal 114 and hot terminal 116. These terminals are conventional in nature and well known in the prior art. Further, it should be emphasized that various other electrical terminal configurations can be utilized for a simplex receptacle in accordance with the invention, without departing from the basic novel concepts of the invention.

The simplex receptacle body 102 also includes a connecting mount 118, comprising an elongated element extending rearwardly from the rear surface 106 of the front portion 108. The connecting mount 118 can be utilized for appropriately securing various elements of the waterproof simplex receptacle 100.

Figures 6, 7, 8, 9, 10, 11, 12:
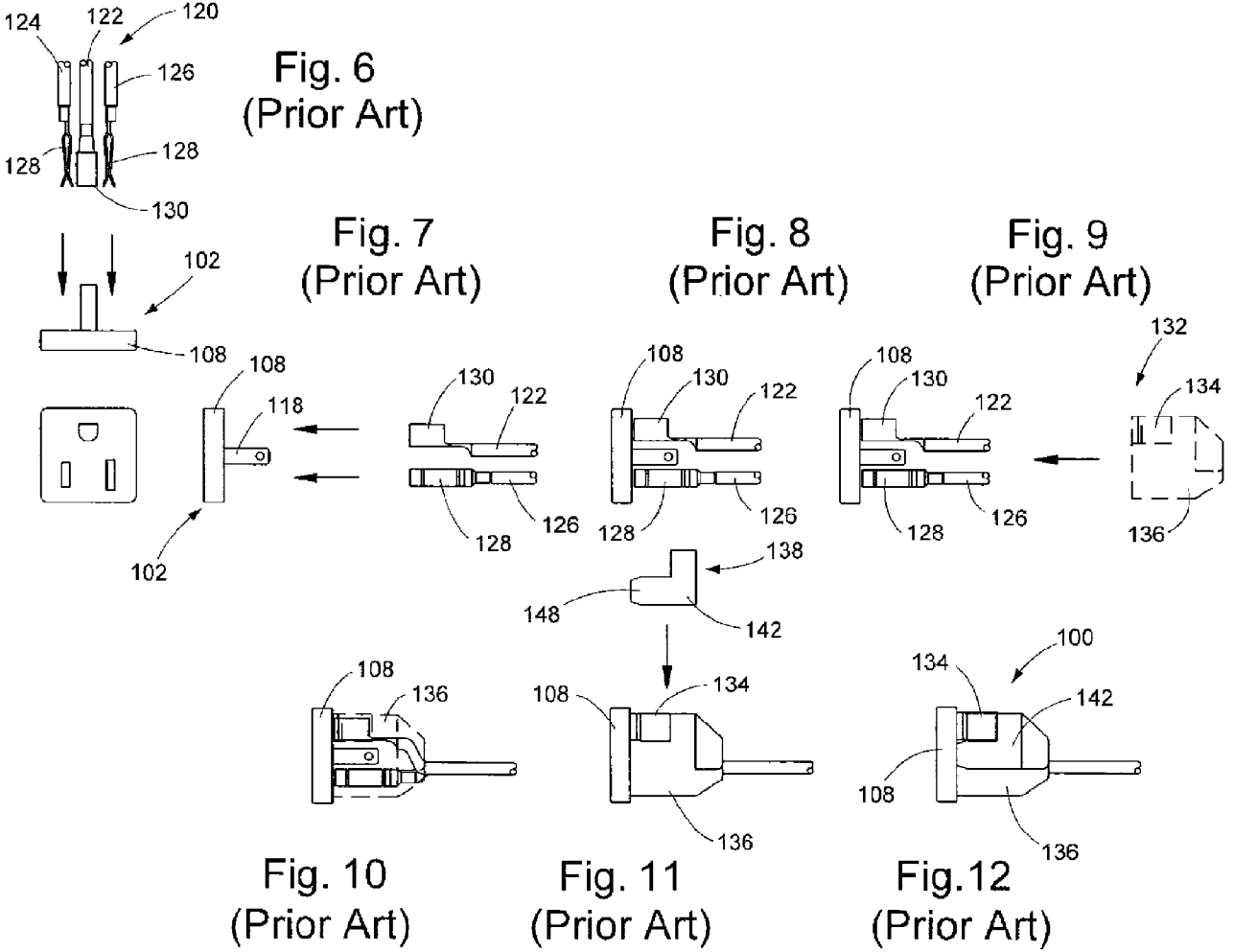
Fig. 6 (Prior Art)
Fig. 7 (Prior Art)
Fig. 8 (Prior Art)
Fig. 9 (Prior Art)
Fig. 10 (Prior Art)
Fig. 11 (Prior Art)
Fig. 12 (Prior Art)
FIG. 6 is a partially exploded and plan view showing the relative positioning of the simplex receptacle body and electrical wires or cables to be connected to the simplex receptacle bodies.
FIG. 7 is a right-side view of the simplex receptacle body and the electrical wires or cables shown in FIG. 6.
FIG. 8 is a right-side view similar to FIG. 7, but showing the electrical wires or cables in an interconnected configuration with the simplex receptacle body.
FIG. 9 is a right-side view showing the interconnected electrical wires or cables and the simplex receptacle body, and further showing a sectional side view of the rear housing to be mounted to the simplex receptacle body.
FIG. 10 is a right-side elevation view similar to FIG. 9, but showing the sectional view of the rear housing as it is positioned when coupled to the simplex receptacle body.
FIG. 11 is a partially exploded and right side view showing the interconnected simplex receptacle body, electrical wires or cables, rear housing and the waterproofing clip positioned so as to be interconnected to the rear housing.
FIG. 12 is a right-side elevation view similar to FIG. 11, but showing the waterproofing clip in its interconnected position.
Figure 18:
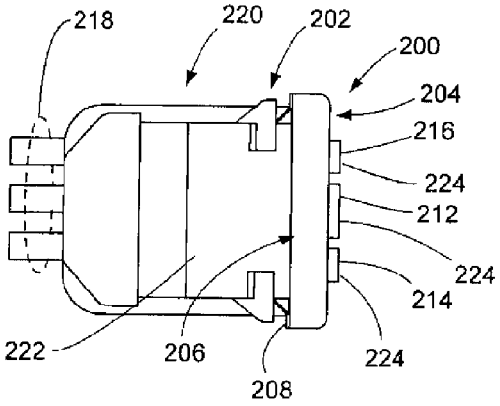
FIG. 18 is a side, elevation view of the receptacle shown in FIG. 17.
Figure 19:
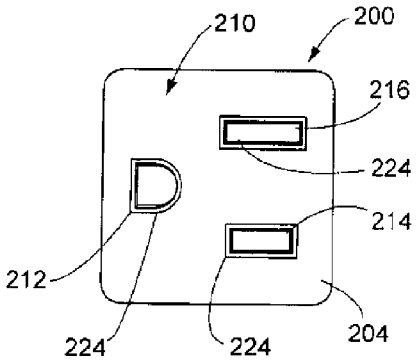
FIG. 19 is a plan view of the receptacle shown in FIG. 17.
Figure 17:
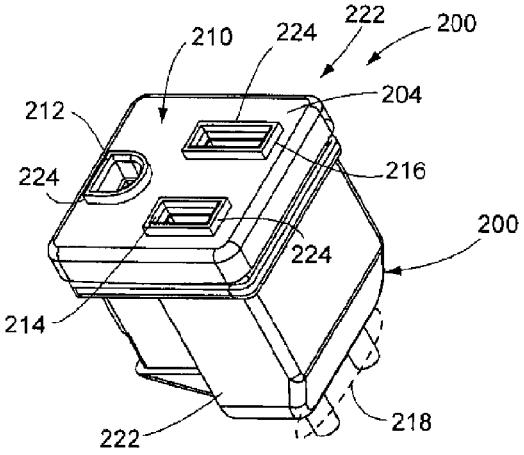
FIG. 17 is a perspective view of a simplex receptacle in accordance with the invention.
Figure 20:
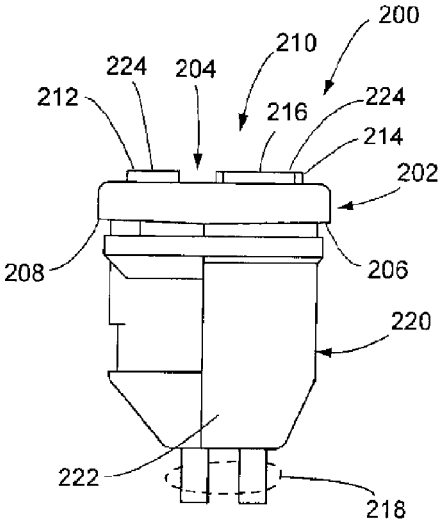
FIG. 20 is a further side, elevation view of the receptacle shown in FIG. 17.

With reference now to FIGS. 6-9, 13 and 14, the waterproof simplex receptacle 100 is adapted to be utilized with a set of electrical wires or cables 120. As shown, for example, in FIGS. 6 and 13, the electrical wires or cables 120 comprise three wires or cables. These three wires or cables 120 further comprise a ground wire 122, neutral wire 124 and hot wire 126. These wires are conventional in nature and may be separate wires, conduit or other type of cabling. Connected at the end of the ground wire 122 is a conventional ground connector 130. Connected to the ends of each of the neutral wire 124 and hot wire 126 is a female connector 128. Again, these connectors are conventional in nature. The ground connector 130 may be connected in any conventional manner to the ground terminal 112 of the simplex receptacle body 102. Correspondingly, the female connector 128 associated with the neutral wire 124 may be electrically connected to the neutral terminal 114 of the receptacle body 102. Still further, the female connector 128 associated with the hot wire 126 may be electrically connected in a conventional manner to the hot terminal 116 of the receptacle body 102. This interconnection is shown in FIGS. 8 and 14.

The waterproof simplex receptacle 100 in accordance with the invention further includes what is characterized as a rear housing 132. The rear housing 132 is shown in FIGS. 9, 10, 11, 12, 15 and 16. With reference to these drawings, the rear housing 132 has a shape and configuration whereby it can be secured to the rear surface 106 of the simplex receptacle body 102, in a manner so as to substantially enclose the electrical wires or cables 120. With reference to the drawings, the rear housing 132 includes an upper box-like structure 134. The upper box structure 134 extends lengthwise across the top of the rear surface 106 of the simplex receptacle body 102. Below the upper box 134 is a main housing body 136. The main housing body 136 has a substantially box-like configuration, and substantially encloses the female connectors 128 associated with the neutral and hot wires 124, 126 respectively. As shown in FIG. 9, the rear housing 132 is inserted as part of the simplex receptacle 100 through the electrical wires or cables 120, and connected by any conventional means to the rear surface 106 of the receptacle body 102.

The waterproof simplex receptacle 100 also includes a waterproofing clip 138. The waterproofing clip 138 is primarily shown in FIGS. 11, 12, 15 and 16. In particular, a perspective view of the waterproofing clip 138 is illustrated in FIG. 15. As shown therein, the waterproofing clip 138 includes an upper portion 140 extending lengthwise across the clip 138. A pair of vertical connecting portions 142 extend downwardly from opposing ends of the upper portion 140. At the lower ends of the vertical connecting portions 142, spring legs 144 extend forwardly from each of the vertical connecting portions 142. These elements of the waterproofing clip 138 may be separate and interconnected, or may preferably be constructed integral with each other. In particular, the spring clips 144 may be resilient in nature and sized so as to be "snap fitted" around the main housing body 136 of the rear housing 132. The spring legs 144 comprise a left leg 146 and right leg 148. As previously stated, the legs 144 are resilient in nature, so as to appropriately snap fit on the rear housing 132, thereby appropriately securing all elements for the waterproof simplex receptacle 100. With the rear housing 132 and the waterproofing clip 138, the rear portion of the simplex receptacle 100 is essentially waterproof, and will resist any seepage of water or other liquids therein.

It should be emphasized that other configurations of the waterproof simplex may be utilized. Also, the concepts associated with the waterproof simplex may be applied to other types of receptacle configurations, such as duplex receptacles. As earlier mentioned, various types of electrical wires or cables may be utilized, and the simplex receptacle may have various terminal configurations, such as the absence of a ground terminal or the like. Still further, it is apparent that one of the advantages of waterproof simplex receptacles in accordance with the invention is that the rear housing and waterproofing clip may be "retrofitted" to existing simplex receptacles. Also, the concepts associated with the waterproof simplex receptacle 100 are not limited with respect to any particular sizes or dimensions of receptacles.

The principles of the invention will now be described with respect to a first embodiment of a waterproof simplex receptacle 200 in accordance with the invention. The simplex receptacle 200 is illustrated in FIGS. 17-20. With reference thereto, the receptacle 200 includes a simplex receptacle body 202, with a front portion 208 having a front surface 204 and rear surface 206. Terminals 210, in the form of female terminals, extend through the front surface 204. The terminals 210 include a ground terminal 212, neutral terminal 214, and hot terminal 216. The terminals 210 are connected to wires 218 extending rearwardly from the receptacle 200.

At the rear of the front portion 208 is a main or rear body housing 220. Releasably secured to the main body housing 220 is a waterproofing clip 222, essentially corresponding to the clip 138 previously described herein.

In accordance with the invention, each of the terminals 210 on the front surface 204 includes an outwardly extending ridge 224. These ridges are particularly shown in FIG. 17. The ridges 224 in accordance with the invention provide two features. First, if the front surface 204 is in any manner horizontal, and liquid is located on the front surface 204, the liquid is prevented from dripping through the terminals 210 through the ridges 224. Further, if the simplex receptacle 200 is laid on its side, so that the front surface 204 is essentially vertically disposed, the ridges 224 will prevent any water or other liquids which are dripping downwardly in a vertical direction from entering the apertures for the terminals 210. In this particular embodiment, two of the ridges 224 are shown as being of a substantially rectangular configuration. These two ridges 224 are separately associated with differing ones of the neutral terminal 214 and hot terminal 216. The other ridge 224, associated with the ground terminal 212, essentially has a semi-circular configuration, substantially corresponding to the shape of the ground terminal 212 itself. It should be emphasized that a number of different configurations could be utilized with respect to the shapes and formats of the ridges, without departing from the novel concepts of the invention.

Figure 21:
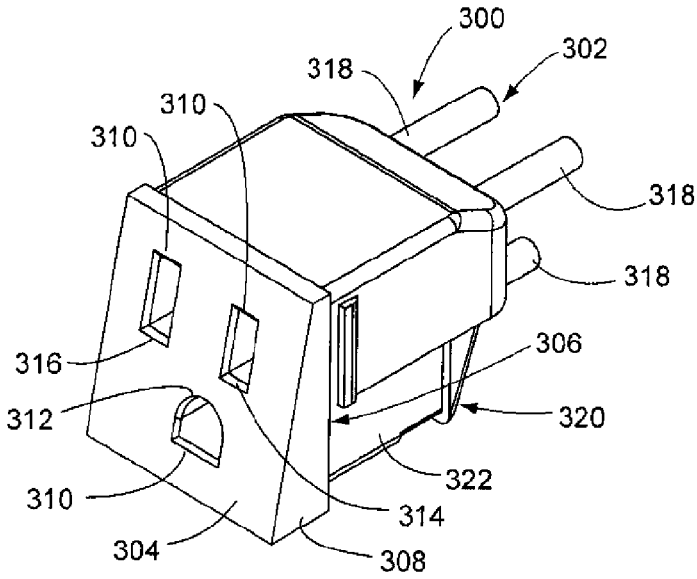
FIG. 21 is a perspective view of a second embodiment of a simplex receptacle in accordance with the invention.
Figure 22:
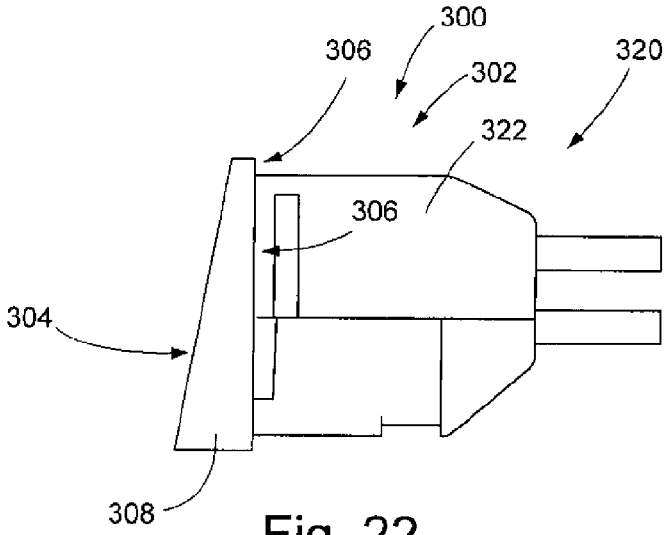
FIG. 22 is a side, elevation view of the receptacle shown in FIG. 21.
Figure 23:
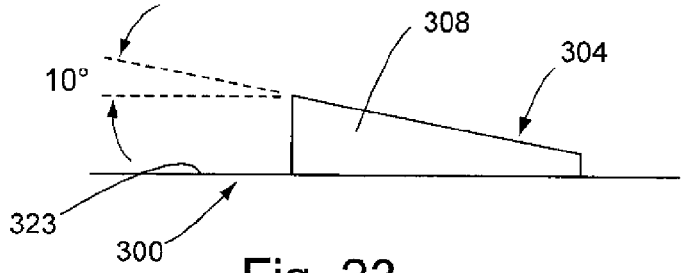
FIG. 23 is a side, elevation view showing the watershedding housing of the receptacle shown in FIG. 21, and showing the same at a 10° angle relative to horizontal.

A second embodiment of a waterproof simplex receptacle in accordance with the invention is shown as receptacle 300 and illustrated in FIGS. 21, 22, and 23. With reference thereto, the receptacle 300 includes a main body 302 and a front portion 308. The front portion 308 includes a front surface 304 and rear surface 306. Terminals 310, which may be in the form of female terminals, extend outwardly from the front surface 304. In accordance with the example embodiment of the receptacle 300, the terminals 310 can include a ground terminal 312, neutral terminal 314 and hot terminal 316. The terminals 310 can be connected to wires 318 extending rearwardly from the receptacle 300.

At the rear of the front portion 308 is a main body housing 320. If desired, a waterproofing clip 322 can be releasably secured to the main body housing 320. The waterproofing clip 322 can essentially correspond to the waterproofing clip 222 and to clip 138 previously described herein. Although the receptacle 300 can include the waterproofing clip 322, the front surface 304 of the front portion 308 does not necessarily have to include any kind of outwardly extending ridges associated with the terminals 310, such as those corresponding to the outwardly extending ridges 224 associated with the terminals 210 of the previously described receptacle 200.

However, in accordance with the invention, the front surface 304 is angled. This angular configuration is particularly shown in FIGS. 22 and 23, where in FIG. 23 only the front portion 308 is shown, and it is indicated therein that the front surface 304 has an angle of 10° when the front portion 308 is laid flat against a horizontal surface 323. With this angled configuration, the front surface 304 will tend to shed water, even when positioned in a supine configuration. It should be emphasized that other angular configurations of front surfaces could be utilized, without departing from the novel concept of the invention.

Figure 24:
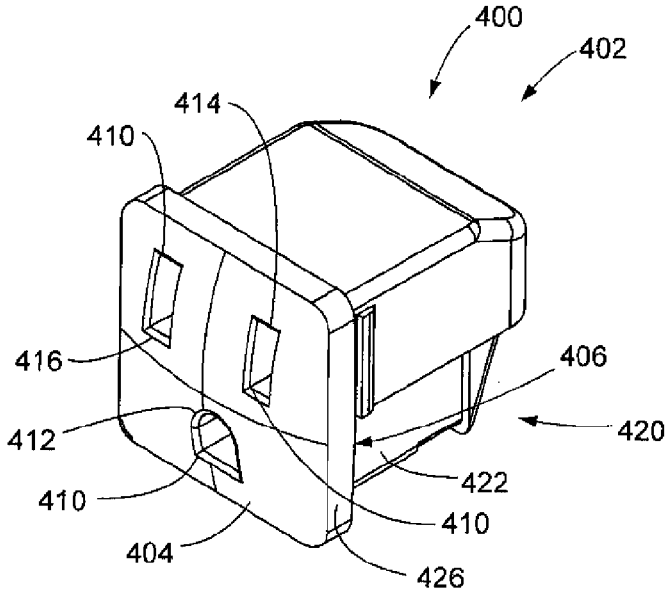
FIG. 24 is a perspective view of a third embodiment of a waterproof simplex receptacle in accordance with the invention.
Figure 25:
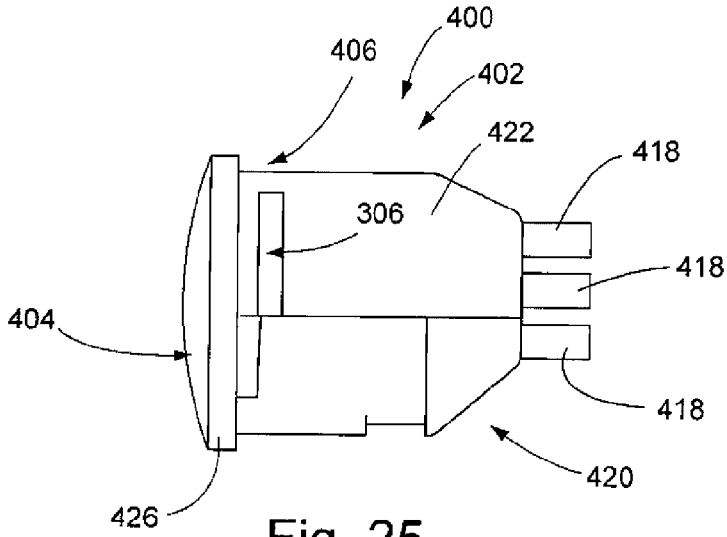
FIG. 25 is a side, elevation view of the receptacle shown in FIG. 24.
Figure 26:
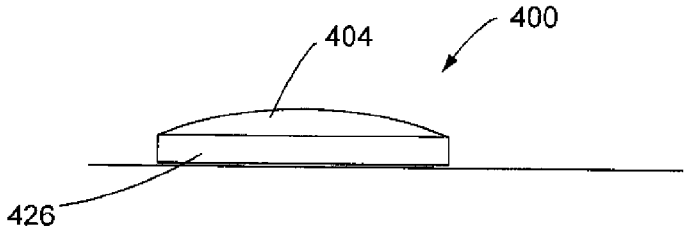
FIG. 26 is a side, elevation view, showing the configuration of the watershedding front housing of the receptacle of FIG. 24.

A third embodiment of a receptacle in accordance with the invention is shown as simplex receptacle 400 illustrated in FIGS. 24, 25, and 26. As shown therein, the receptacle 400 includes a main receptacle body 402 extending rearwardly and housing the general circuitry of the receptacle 400. Positioned at the front of the main body 402 is a front portion 408. The front portion 408 includes a front surface 404 and rear surface 406. Terminals 410 extend outwardly from the front surface 404. The terminals 410 are shown in FIG. 24 as including a ground terminal 412, neutral terminal 414 and hot terminal 416. Wires 418 extend rearwardly from the body 402. In accordance with the invention, and as particularly shown in FIG. 24, the front surface 304 has a curved configuration, whereby each point on the front surface 404 is sloping outwardly toward an edge 426 of the front portion 408. With this configuration, and with the front portion laying supine as shown in FIG. 26, any water or other liquid which drips downwardly onto the front surface 404 will be directed outwardly toward the edge 426 and off the front surface 404. Again, it may be emphasized that the front surface 404 is shown with a particular curvature. However, the invention is not limited to the specific curvature shown for the front surface 404.

Figure 27:
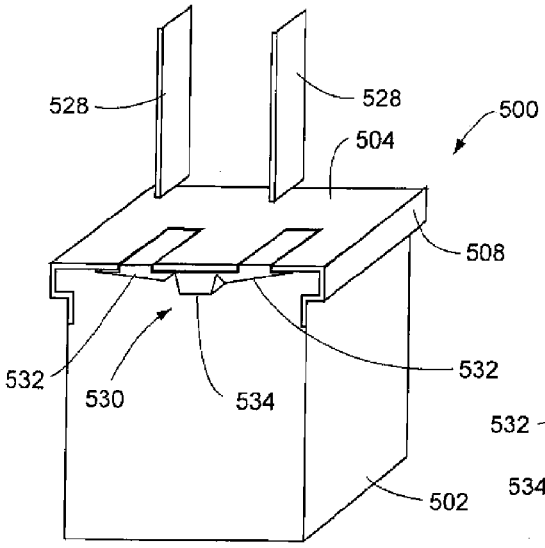
FIG. 27 is a perspective and exploded view of a simplex receptacle, and showing means for providing a liquid dam when internal blades are inserted into the receptacle.
Figure 28:
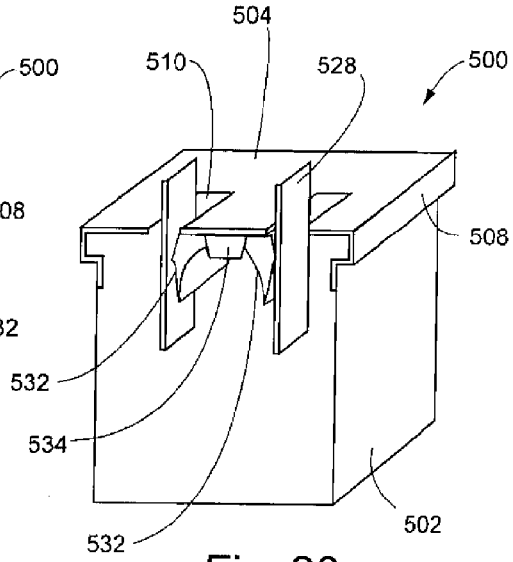
FIG. 28 is a perspective view of the receptacle shown in FIG. 27, with the terminal blades inserted into the receptacle.

A further embodiment of the invention is shown as a simplex receptacle 500 as illustrated in FIGS. 27 and 28. With reference thereto, the receptacle 500 includes a main receptacle body 502, having a front portion 508. The front portion 508 includes a front surface 504. Terminals 510 extend outwardly from the front surface 504. In this particular instance, only two of the terminals 510 are illustrated. Also illustrated is a pair of terminal blades 528 which can be conductively received within the terminals 510.

In accordance with the invention, and for purposes of preventing water from seeping into the terminals 510 when not in use, a resilient protective element 530 is positioned immediately below and in between the terminals 510. The protective element 530 includes a pair of resilient portions 532 which resiliently cover each of the terminals 510 when not in use. The resilient portions 532 are connected together by a mid-section 534. When the terminal blades 528 are inserted into the terminals 510, as is expressly shown in FIG. 28, the resilient portions 532 of the protective element 530 will bend inwardly and downwardly. With this movement, the terminal blades 528 are free to move into the terminals 510. When the blades 528 are again removed from the terminals 510, the resilient portions 532 will resiliently return to a position as shown in FIG. 27, where they are essentially shielding terminals 510.

Figure 29:
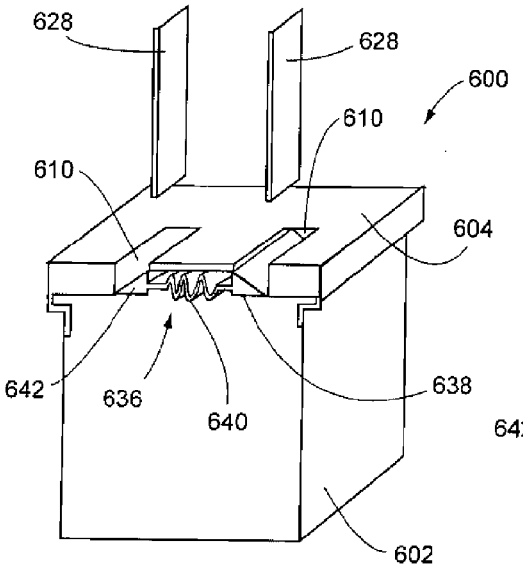
FIG. 29 is a further embodiment of a simplex receptacle, showing a differing dam configuration, and further showing the terminal blades and a receptacle in an exploded view.
Figure 30:
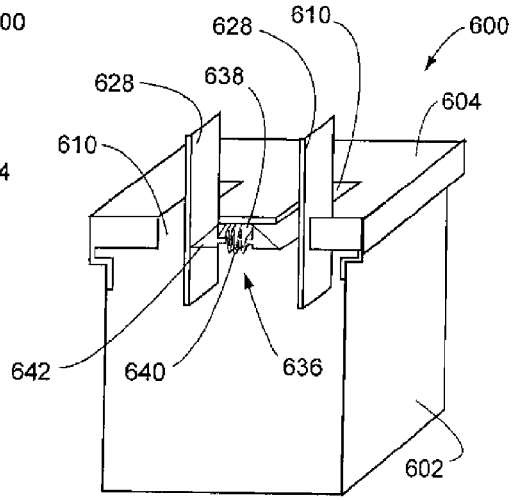
FIG. 30 is a perspective view of the receptacle shown in FIG. 29, with the terminal blades extended into the receptacle.

A still further embodiment somewhat similar to the receptacle 500 is shown as receptacle 600 in FIGS. 29 and 30. As shown therein, the receptacle 600 includes a main body 602, with a front portion 608. The front portion 608 includes a front section 604, having a pair of terminals 610 extending outwardly therefrom. Terminal blades 628 are adapted to be received within the terminals 610. For purposes of shielding the terminals 610 when not in use, the receptacle 600 includes a baffle element 636 positioned as particularly shown in FIG. 29, when the terminals 610 are not in use. The baffle element 636 includes a baffle mid-portion 640. The baffle mid-portion 640 is connected at one end to a resilient and triangular wedge 638 which extends upwardly into and covers one of the terminals 610 when not in use. A flat portion 642 is connected to the opposing end of the baffle mid-portion 640. When the blades 628 are extended into the terminals 610, the triangular wedge is made to move downwardly so as to be free to move in a horizontal configuration. With the baffle mid-portion essentially holding the flat portion 642 and triangular wedge 638 in a configuration where the baffle mid-portion 640 wants to contract, the mid-portion 640 is free to contract when the triangular wedge 638 is removed from abutment with one of the terminals 610. The flat portion 642 can also be connected to a wedge or similar element which abuts the other terminal 610. Accordingly, when the blades 628 are extended downwardly, the baffle element 636 will be capable of contracting to the configuration shown in FIG. 30. With this contraction, the terminal blades 628 are free to move downwardly and into the terminals 610. When they are removed, the baffle element 636 can return to the state shown in FIG. 29.

It will be apparent to those skilled in the pertinent arts that other embodiments of the invention can be designed. That is, the principles of the invention are not limited to the specific embodiments described herein. Accordingly, it will be apparent to those skilled in the art that modifications and other variations of the above-described illustrative embodiments of the invention may be effected without departing from the spirit and scope of the novel concepts of the invention.

The invention claimed is:

1. An electrical receptacle assembly having at least one receptacle, said receptacle assembly comprising:

a receptacle body having a rear housing and a front body portion, said front body portion having a front surface and a rear surface, said front surface defining an outermost surface of said electrical receptacle assembly and having a first front surface portion and a second front surface portion, said rear surface of said front body portion located forwardly of said rear housing and extending laterally outwardly from said rear housing, and said rear surface of said front body portion defining another outermost surface of said electrical receptacle assembly;

a plurality of terminal passageways formed in said receptacle body and open to respective terminal openings surrounded by said first front surface portion of said front surface, said terminal passageways configured for receiving respective prongs of an electrical plug of an electrical device to be energized;

a plurality of electrical terminals disposed in said terminal passageways and positioned rearwardly from said terminal openings;

wherein said first front surface portion projects forwardly relative to said second front surface portion when said electrical receptacle assembly is fully assembled and configured to engage the electrical plug; and wherein said first and second front surface portions are configured so that if said rear surface of said front body portion is positioned at an angle between horizontal and vertical, inclusive, liquid located on said front surface of said front body portion will be directed away from said first front surface portion as a result of said configuration of said first front surface portion relative to said second front surface portion.

2. The electrical receptacle assembly of claim 1, wherein said front surface of said front body portion defines a convex curved shape.

3. The electrical receptacle assembly of claim 2, wherein said second front surface portion defines a perimeter region of said front surface of said front body portion, with said second front surface portion at least partially surrounding said first front surface portion.

4. The electrical receptacle assembly of claim 3, wherein said first front surface portion forms a central region of said front surface of said front body portion, and said second front surface portion forms a perimeter region of said front surface of said front body portion, whereby said second front surface portion substantially surrounds said first front surface portion.

5. The electrical receptacle assembly of claim 1, wherein:

said first front surface portion is substantially planar and defines said terminal openings;

said first and second front surface portions are substantially co-planar and adjacent one another; and said front surface of said front body portion, including said first and second front surface portions, is angled so that said terminal openings in said first front surface portion are positioned forwardly of said second front surface portion.

6. The electrical receptacle assembly of claim 1, wherein said first front surface portion comprises a plurality of outwardly-extending ridge portions that are substantially surrounded by said second front surface portion of said front surface of said receptacle body.

7. The electrical receptacle assembly of claim 6, wherein said second front surface portion and respective forward surfaces of said outwardly-extending ridge portions are substantially planar and are substantially parallel to one another.

8. An electrical receptacle assembly having at least one electrical receptacle, said electrical receptacle assembly comprising:

a receptacle body including a rear housing and a front body portion, said front body portion defining a plurality of terminal passageways extending therethrough;

said front body portion comprising a front surface that forms an outermost surface of said electrical receptacle assembly when said electrical receptacle assembly is fully assembled and configured to engage an electrical plug, and said front body portion comprising a rear surface located forwardly of said rear housing and extending laterally outwardly from said rear housing, and said rear surface of said front body portion defining another outermost surface of said electrical receptacle assembly;

said front body portion further defining a plurality of terminal openings at respective front ends of said terminal passageways, and said front surface of said front body portion comprising an inboard front surface portion surrounding each of said terminal openings and an outboard front surface portion located outwardly of said inboard front surface portion;

electrical terminals in said receptacle body, which are associated with respective ones of said terminal passageways, wherein said electrical terminals are configured to be electrically coupled to respective electrical supply conductors, and said electrical terminals are configured to receive respective prongs of the electrical plug so that the prongs are electrically connectable to said electrical terminals;

wherein said inboard front surface portion is positioned forwardly of said outboard front surface portion when said electrical receptacle assembly is fully assembled and configured to engage the electrical plug, and whereby said terminal openings are positioned forwardly of said outboard front surface portion of said front body portion; and wherein said front surface of said front body portion is configured so that if said rear surface of said front body portion is oriented at substantially any angle between horizontal and vertical, inclusive, liquid located on said front surface of said front body portion will be directed away from said terminal openings as a result of said configuration of said inboard front surface portion relative to said outboard front surface portion.

9. The electrical receptacle assembly of claim 8, wherein said outboard front surface portion is substantially planar.

10. The electrical receptacle assembly of claim 9, wherein inboard front surface portion is substantially planar and parallel to said outboard front surface portion.

11. The electrical receptacle assembly of claim 10, wherein:

said inboard and outboard front surface portions are substantially co-planar and adjacent one another; and said front surface of said front body portion, including said inboard and outboard front surface portions, is angled so that said terminal openings in said inboard front surface portion are positioned forwardly of said outboard front surface portion.

12. The electrical receptacle assembly of claim 9, wherein said inboard front surface portion comprises a plurality of outwardly-extending ridge portions that are substantially surrounded by said outboard front surface portion of said front surface of said receptacle body.

13. The electrical receptacle assembly of claim 12, wherein respective forward surfaces of said outwardly-extending ridge portions are substantially planar and are substantially parallel to said outboard front surface portion.

14. The electrical receptacle assembly of claim 8, wherein said inboard surface of said front body portion defines a convex curved shape.

15. The electrical receptacle assembly of claim 14, wherein said outboard front surface portion defines a perimeter region of said front surface, with said outboard front surface portion at least partially surrounding said inboard front surface portion.

16. The electrical receptacle assembly of claim 15, wherein said inboard and outboard front surface portions cooperate to define a substantially continuous convex curved shape, with said outboard front surface portion substantially surrounding said inboard front surface portion.

17. An electrical receptacle assembly having at least one electrical receptacle, said electrical receptacle assembly comprising:

a receptacle body including a rear housing and a front body portion, said front body portion defining a plurality of terminal passageways extending therethrough, said front body portion comprising a front surface forming an outermost surface of said electrical receptacle assembly when said electrical receptacle assembly is fully assembled and configured to engage an electrical plug, and said front body portion comprising a rear surface located forwardly of said rear housing and extending laterally outwardly from said rear housing, and said rear surface of said front body portion defining another outermost surface of said electrical receptacle assembly;

said front body portion further defining a plurality of terminal openings at respective front ends of said terminal passageways;

said front surface of said front body portion comprising substantially planar first and second front surface portions, wherein said first front surface portion defines at least one of said terminal openings and is positioned forwardly of said second front surface portion, whereby said first front surface portion forms the forwardmost portion of said front surface of said front body portion of said electrical receptacle assembly when said electrical receptacle assembly is fully assembled and configured to engage the electrical plug, and whereby at least one of said terminal openings is positioned forwardly of said second front surface portion;

a plurality of electrical terminals disposed in said receptacle body, which are electrically accessible via respective ones of said terminal passageways for electrically coupling to respective prongs of the electrical plug when the prongs are inserted through said terminal openings and into said terminal passageways; and wherein said front surface is configured so that if said rear surface of said front body portion is oriented at an angle between horizontal and vertical, inclusive, liquid located on said front surface will be directed away from said terminal openings as a result of said configuration of said first front surface portion relative to said second front surface portion.

18. The electrical receptacle assembly of claim 17, wherein said first and second front surface portions are substantially co-planar and adjacent one another, and are angled so that said terminal openings in said first front surface portion are positioned forwardly of said second front surface portion.

19. The electrical receptacle assembly of claim 17, wherein said front body portion comprises an outwardly-extending ridge portion surrounding at least one of said terminal openings.

* * * * *